US012780472B2

(12) United States Patent
Trombetti et al.

(10) Patent No.: US 12,780,472 B2
(45) Date of Patent: Nov. 3, 2026

(54) WRAPPING MACHINE AND WRAPPING METHOD

(71) Applicant: AETNA GROUP S.P.A., Verucchio (IT)

(72) Inventors: Aldo Trombetti, Verucchio (IT); Gianluca Di Marzio, Verucchio (IT); Stefano Ferrannina, Verucchio (IT)

(73) Assignee: AETNA GROUP S.P.A., Verucchio (IT)

( * ) Notice: Subject to any disclaimer, the term of this patent is extended or adjusted under 35 U.S.C. 154(b) by 0 days.

(21) Appl. No.: 18/856,251

(22) PCT Filed: Apr. 12, 2023

(86) PCT No.: PCT/IB2023/053749

§ 371 (c)(1),
(2) Date: Oct. 11, 2024

(87) PCT Pub. No.: WO2023/199246

PCT Pub. Date: Oct. 19, 2023

(65) Prior Publication Data

US 2025/0197044 A1 Jun. 19, 2025

(30) Foreign Application Priority Data

Apr. 13, 2022 (IT) ..... 102022000007373
Apr. 13, 2022 (IT) ..... 102022000007379

(51) Int. Cl.
*B65B 41/16* (2006.01)
*B65B 11/04* (2006.01)
(Continued)

(52) U.S. Cl.
CPC ..... *B65B 41/16* (2013.01); *B65B 11/045* (2013.01); *B65B 35/50* (2013.01); *B65B 61/06* (2013.01)

(58) Field of Classification Search
USPC ..... 53/447
See application file for complete search history.

(56) References Cited

U.S. PATENT DOCUMENTS 10,703,519 B2 7/2020 Ceré
2018/0162567 A1* 6/2018 Ceré ..... B65B 21/245
2018/0290776 A1* 10/2018 Ceré ..... B65B 41/14

FOREIGN PATENT DOCUMENTS

CA 3 058 590 4/2021
EP 0 336 517 7/1992

OTHER PUBLICATIONS

International Search Report (ISR) issued Aug. 4, 2023 in Internation (PCT) Application No. PCT/IB2023/053749.

* cited by examiner

*Primary Examiner* — Chinyere J Rushing-Tucker
(74) *Attorney, Agent, or Firm* — Wenderoth, Lind & Ponack, L.L.P.

(57) ABSTRACT

A wrapping machine for wrapping a load includes an unwinding unit, provided with a reel of film and rollers for unwinding and/or pre-stretching the film, a moving assembly for supporting and moving the unwinding unit along an operating direction and a transfer system fixed to and supported by the unwinding unit and configured to transfer an initial flap of film unwound by the rollers into a wrapping area of the wrapping machine where the load is wrapped with the film. The transfer system includes a blowing arrangement positioned downstream of the rollers and configured to blow air towards the wrapping area to push and guide the initial flap along an unwinding direction towards the wrapping area, and a gripping assembly adjacent to blowing arrangement and adapted to grasp and retain the initial flap during a pause step when the load is not wrapped with the film.

20 Claims, 7 Drawing Sheets

(51) Int. Cl.
*B65B 35/50* (2006.01)
*B65B 61/06* (2006.01)

Fig. 2
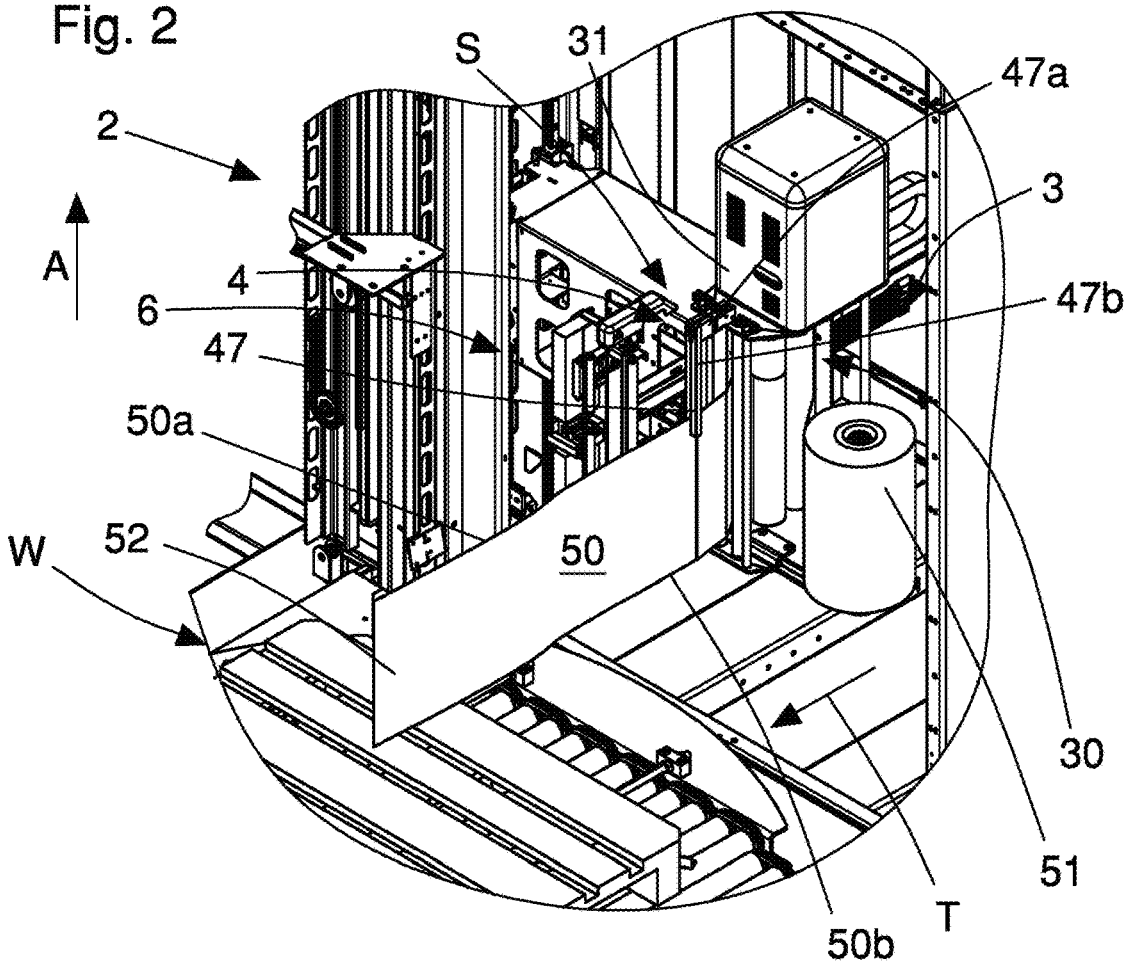
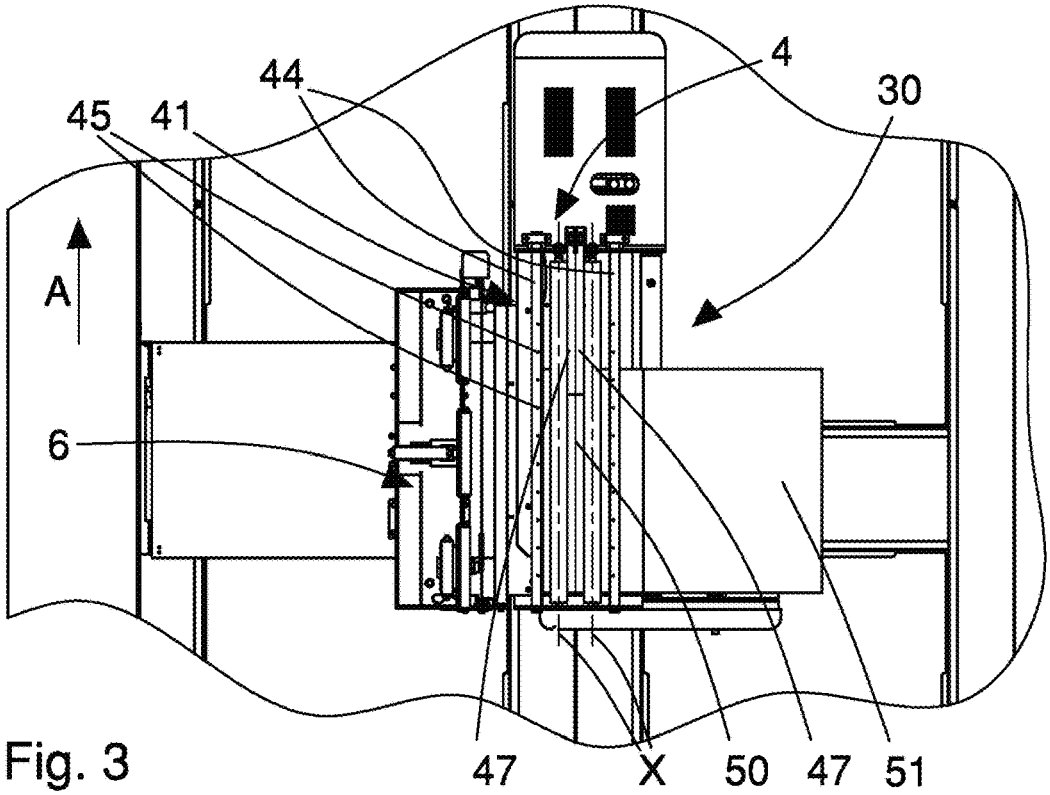
Fig. 3

Fig. 4
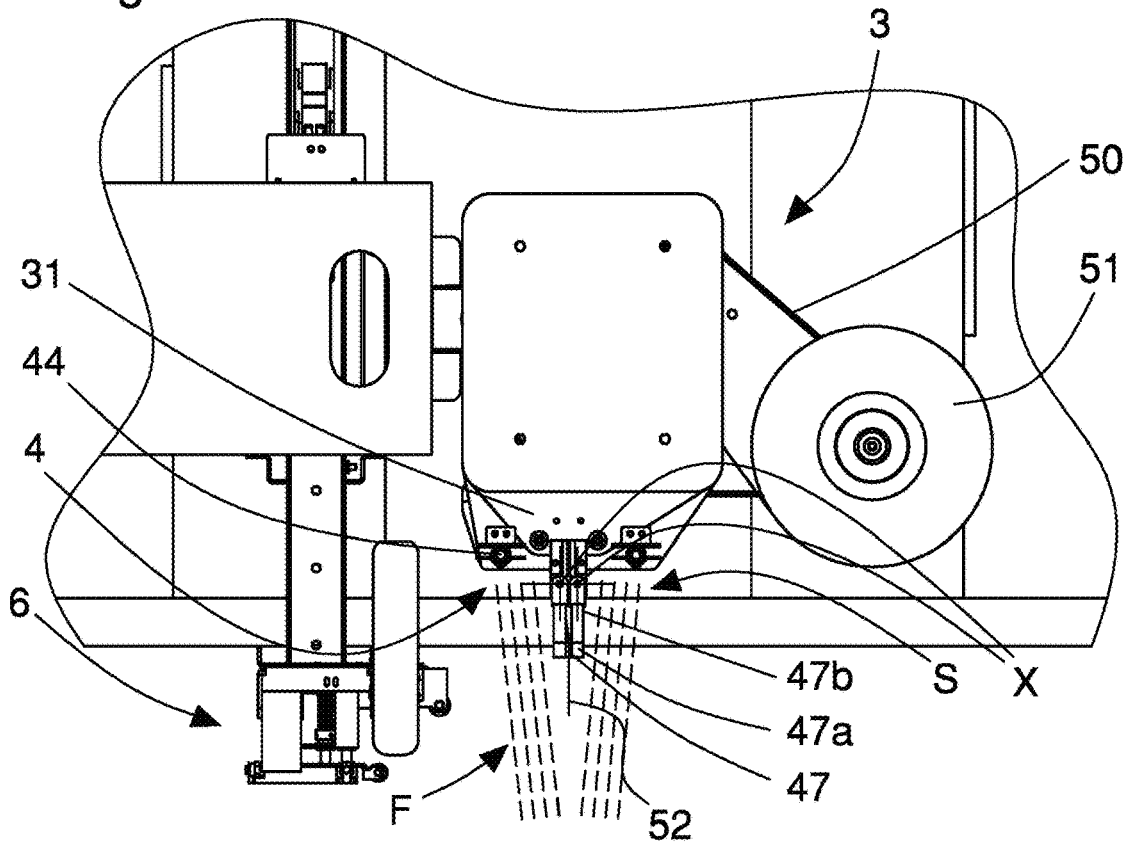
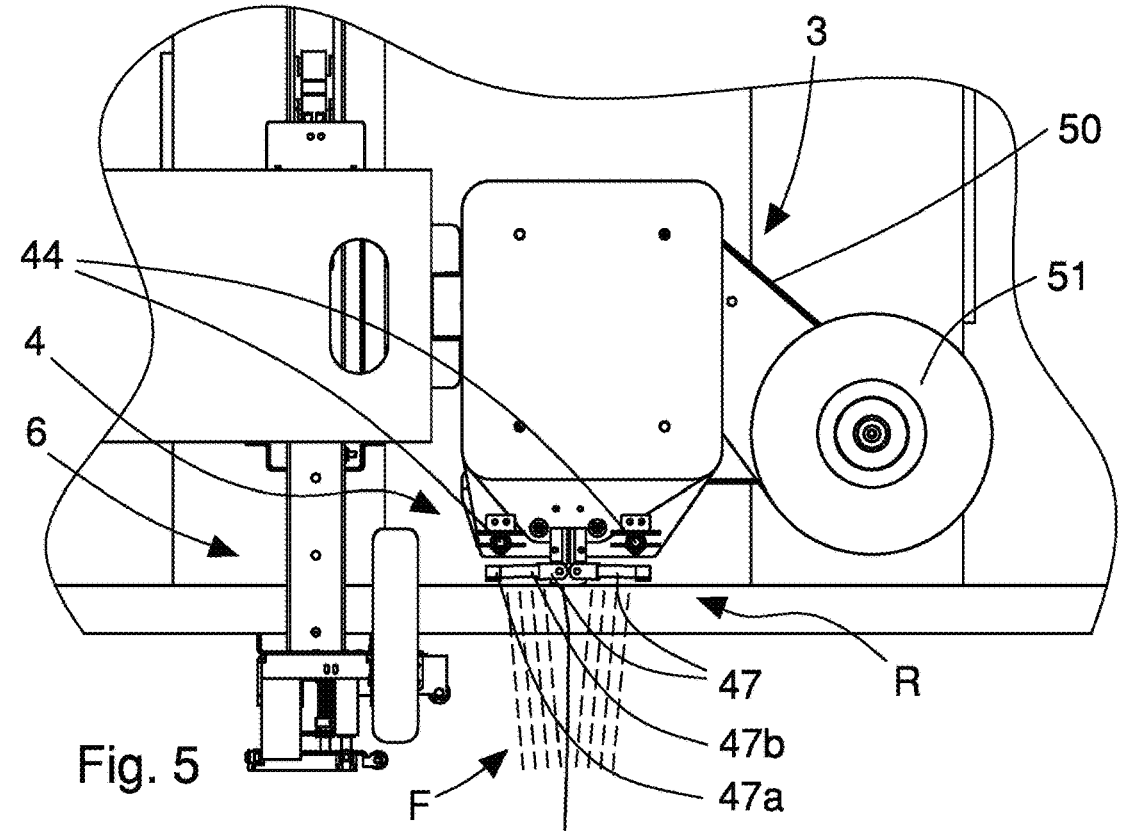
Fig. 5

Fig. 9
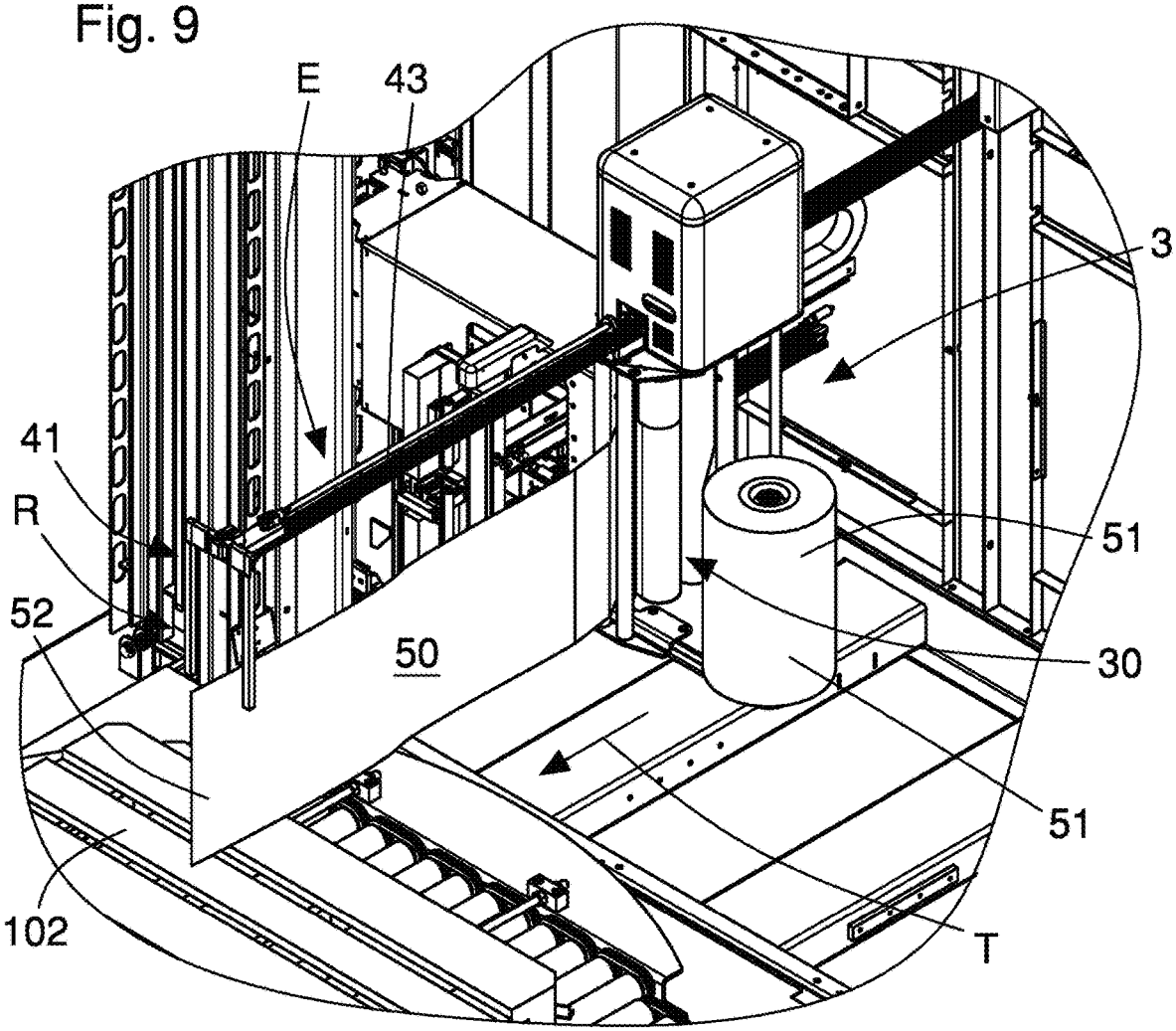
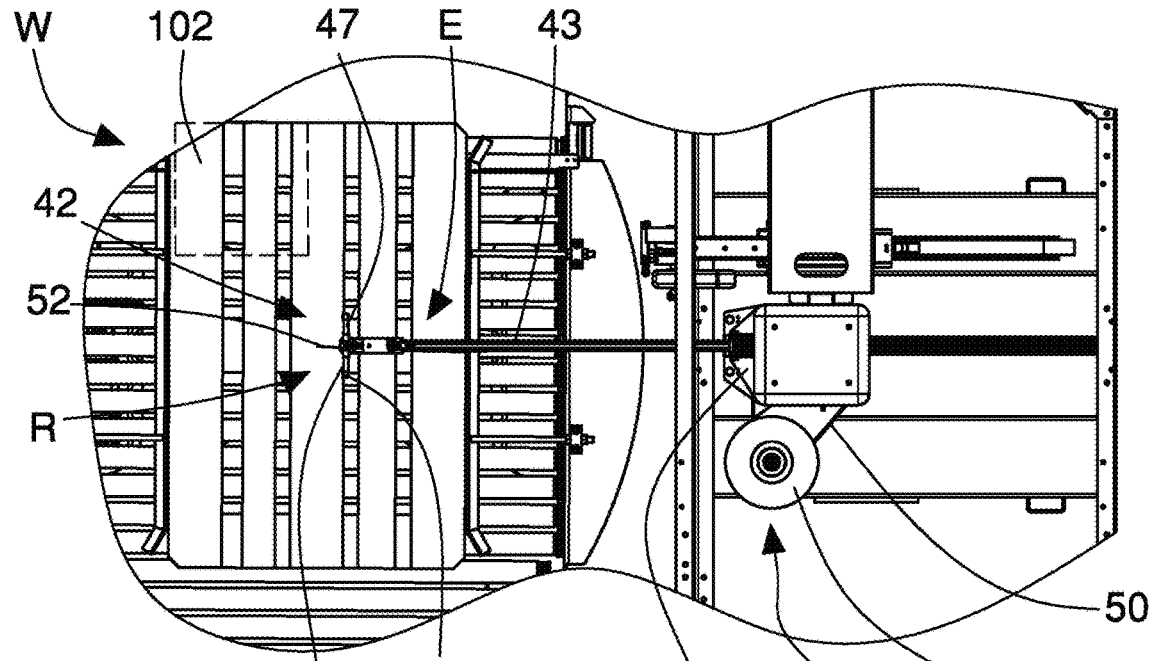
Fig. 10

WRAPPING MACHINE AND WRAPPING METHOD

The invention relates to machines and methods for wrapping a load with a film or web of extensible plastic material.

The practice of wrapping a load consisting of a single product or a plurality of products grouped and/or stacked on a pallet, with an extensible plastic film or web, in particular cold-extensible film, is well-known in the packaging sector.

The known wrapping machines comprise an unwinding unit which is movable parallel to and/or about a wrapping axis and which supports a reel of film from which the film is unwound to be wrapped around the load so as to form a series of strips or bands generally having a helical movement, due to the combination of the relative linear and rotational movements between the unwinding apparatus and the load.

In wrapping machines provided with a rotating table or platform supporting the load, the load is rotated about a vertical wrapping axis, while the unwinding unit is moved vertically in an alternating motion along a supporting column.

In wrapping machines with horizontal rotating ring or rotating arm, the load remains motionless on suitable supporting and moving means during the wrapping, while the unwinding unit is moved with respect to the load both in rotation about a vertical wrapping axis and in translation parallel to the wrapping axis.

In particular, applications in the packaging sector, wrapping machines, in particular of the rotary table type, are associated with palletizers, i.e. automatic machines arranged to make up a load by placing the various products or articles or elements that compose the load grouped on a pallet, on one or more superimposed layers.

In the case of unstable or light products, the film is applied in a gradual and progressive manner, that is, it is wrapped at the same time as the deposition of a layer of products on the pallet. In this way, the load is stabilized by the film as it is arranged.

The unwinding unit supports the film reel and comprises a pair of pre-stretch rollers arranged to unwind the film from the reel and stretch it, or elongate it, and one or more return rollers arranged to divert the film towards the load. By appropriately adjusting the difference between the rotation speeds of the pre-stretch rollers, it is possible to stretch the film exiting the unwinding apparatus by a defined amount.

At the end of the wrapping, that is, when the load has been wrapped with a set number of interlaced bands of film, the relative rotation between the unwinding unit and the load is stopped in order to fix an end flap of the film to the load and thus block the wrapping. To perform this operation, gripping apparatuses are generally used, which allow the film to be grasped and retained at an area between the unwinding unit and the load, and welding and cutting apparatuses that allow an end flap of the film to be fixed and separated from the load. More precisely, a portion of the film is pressed by a sealing element against the film that is wrapped on the load. The portion of film welded on the wrapped film blocks the wrapping around the load.

After welding, the film is cut in such a way as to make a first (end) flap, which is welded and fixed to the load, and a second (initial) end flap which is connected to the reel and retained by the gripping apparatus to allow the wrapping of a subsequent load. The gripping apparatus releases the film once the wrapping of a subsequent load has begun, typically after at least one round of wrapping. The initial flap of film can thus be wrapped by the film itself about the load.

The gripping apparatus and the welding and cutting apparatus are generally positioned on the rotatable table or next and adjacent to the latter or to the means for supporting and moving the load in order to allow the film to be fixed not only to the load but also to a pallet on which the load is positioned.

The gripping apparatus typically comprises pliers provided with two opposing movable jaws or noses capable of grasping and retaining the film and then releasing it when the wrapping is started. The pliers are vertically arranged. In the open position the two jaws are spaced in order to release the film and allow the film to be wrapped around the load, while in the closed position the jaws are in abutment so as to grasp and retain the film.

A drawback of the known gripping apparatuses lies in the dimensions of the pliers, in particular of the jaws, which must be such as to allow a correct and firm gripping of the film in the closed position and the free wrapping of the film around the load in the open position. However, the two requirements are in opposition to one another. The jaws must in fact have a sufficient length to grasp and retain a suitably long portion of film so as to prevent, during wrapping, rips or tears of the aforementioned portion, with consequent detachment of the end flap of film, following the tensile stresses acting on the film itself. The jaws at the same time must have a reduced length in order not to limit and prevent the wrapping by interfering with the film, in particular the wrapping of lower portions of the load and of the underlying pallet.

To overcome this drawback the pliers are generally interchangeable, and can be replaced based on the load size and/or the band width of the film.

However, this solution is expensive and complex because it requires a set of grippers with different sizes and replacement operations that require the wrapping machine, and therefore the production, to be stopped.

Alternatively, to overcome this drawback, apparatuses are known that allow the width of the film to be reduced, substantially by corrugating and narrowing the end flap and the portion of film to be welded and retained. For this purpose the welding and cutting apparatus or the unwinding apparatus comprises a gripping element (e.g. a spring) which grips and corrugates the film. However, this solution is expensive and complex.

Another drawback of the known gripping apparatuses lies in that, during the opening of the pliers in the releasing step, due to the relative rotation of the load with respect to the unwinding apparatus, the film can adhere, wrap and remain entangled to one of the jaws of the pliers, thus causing a malfunction of the same pliers in the subsequent gripping step of the film and/or an incorrect wrapping of the load, the end flap of the film not being wrapped correctly around the load.

An object of the invention is to improve the known machines and methods for wrapping a load with a plastic film made of extensible material.

Another object of the invention is to provide a wrapping machine and a wrapping method that allow, at each wrapping cycle, a flap of film to be automatically provided for starting a wrapping cycle, and an end flap of film, regardless of its band width, to be correctly and firmly grasped and retained at the end of the wrapping cycle.

A further object is to realize a wrapping machine whose means for gripping the flap of film do not interfere with the wrapping of the load and allow the film to be easily and correctly released.

Yet another object is to realize a wrapping machine having reliable operation and low cost.

In a first aspect of the invention a wrapping machine according to claim 1 is provided.

In a second aspect of the invention a method for wrapping a load according to claim 11 is provided.

In a third aspect of the invention a wrapping machine according to claim 14 is provided.

In a fourth aspect of the invention a method for wrapping a load is provided.

The invention will be better understood and implemented with reference to the accompanying drawings, which illustrate exemplary and non-limiting embodiments thereof, wherein:

FIG. 2 is a enlarged partial view of the wrapping machine of FIG. 1 illustrating in particular an unwinding unit;

FIG. 3 is a partial and enlarged frontal view of the wrapping machine of FIG. 1 illustrating the unwinding unit;

FIGS. 4 and 5 are partial and enlarged plan views of the wrapping machine of FIG. 1 illustrating the unwinding unit of the machine that is the object of the invention of FIG. 2, wherein the gripping means are respectively in the gripping position and in the releasing position;

FIG. 9 is a partial enlarged view of the wrapping machine of FIG. 8 illustrating in particular the unwinding unit;

FIG. 10 is a plan view of the wrapping machine of FIG. 8 illustrating in particular the unwinding unit;

Figure 1:
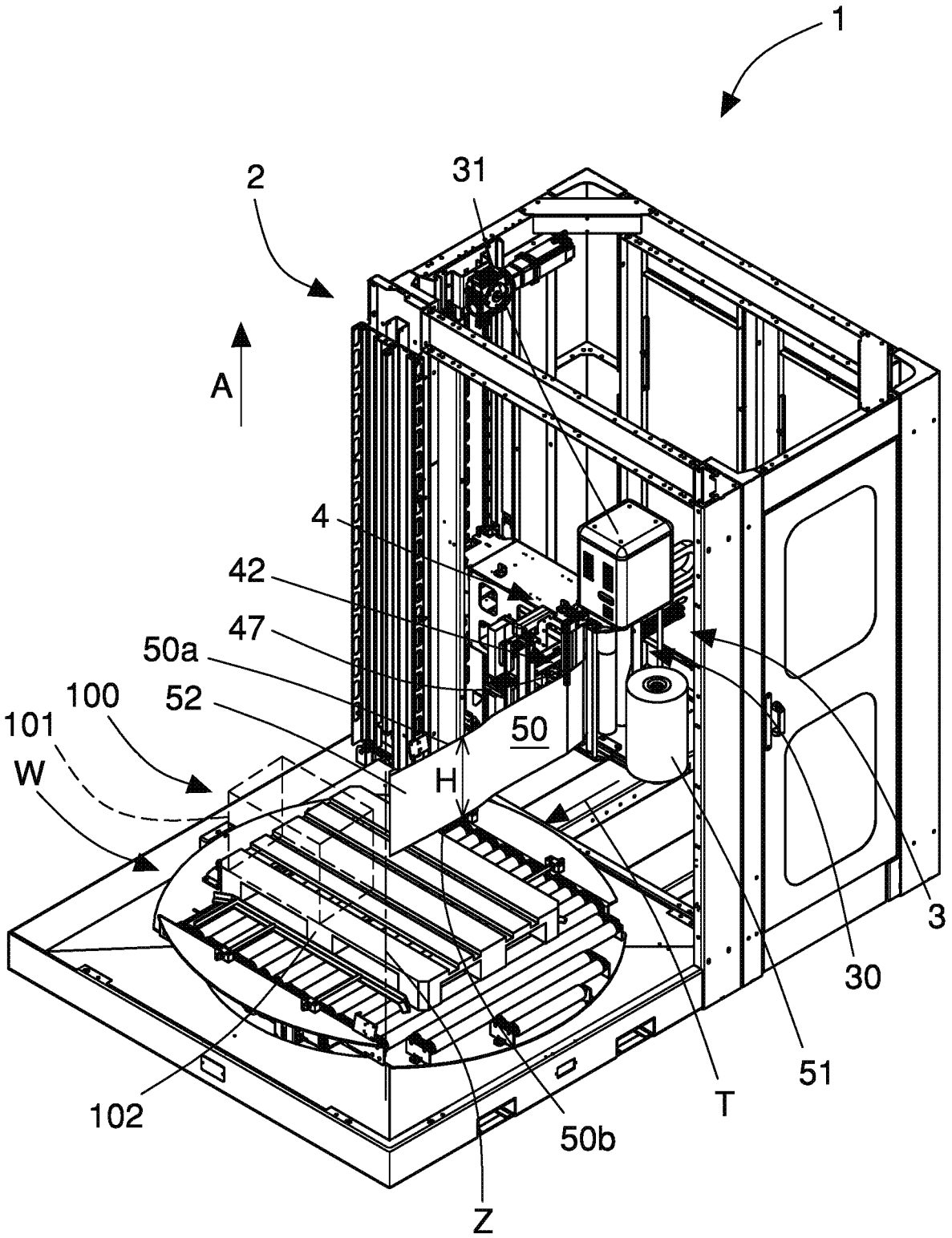
FIG. 1 is a perspective view of an embodiment of the wrapping machine according to the invention with gripping means in a gripping position.
Figure 7:
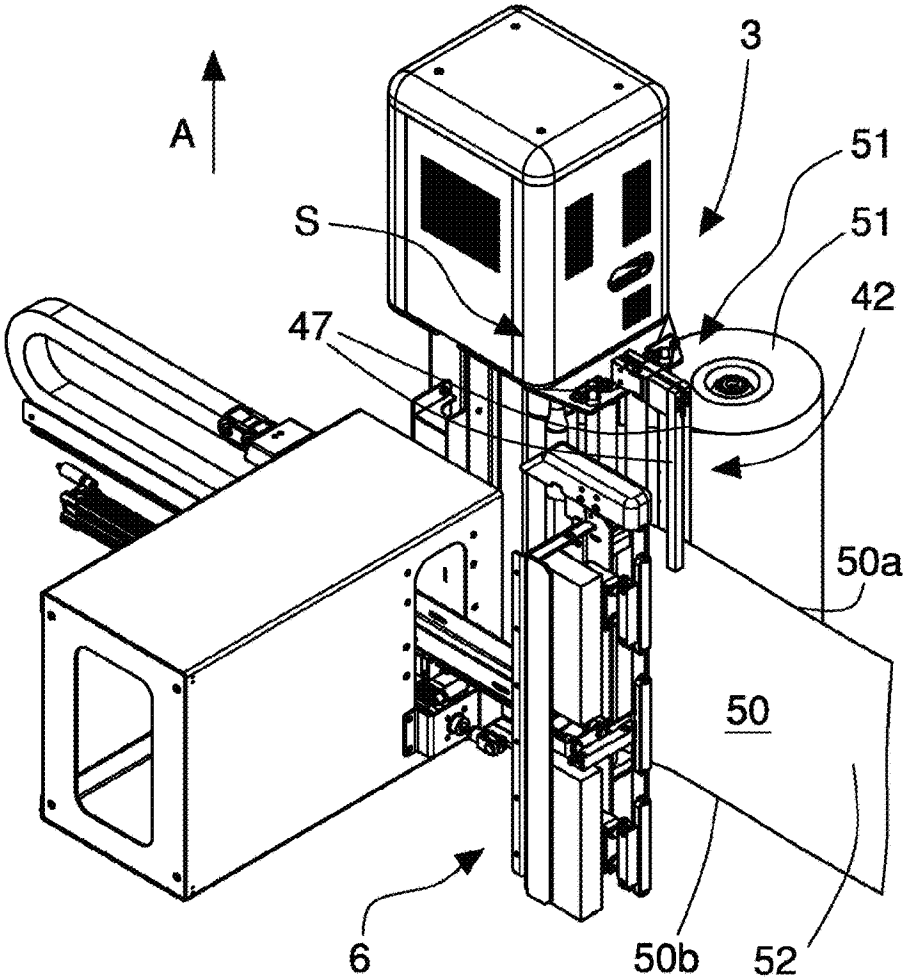
FIGS. 6 and 7 are perspective views from different angles of the unwinding unit of the machine of FIG. 1, with the gripping means respectively in the releasing position and in the gripping position.
Figure 6:
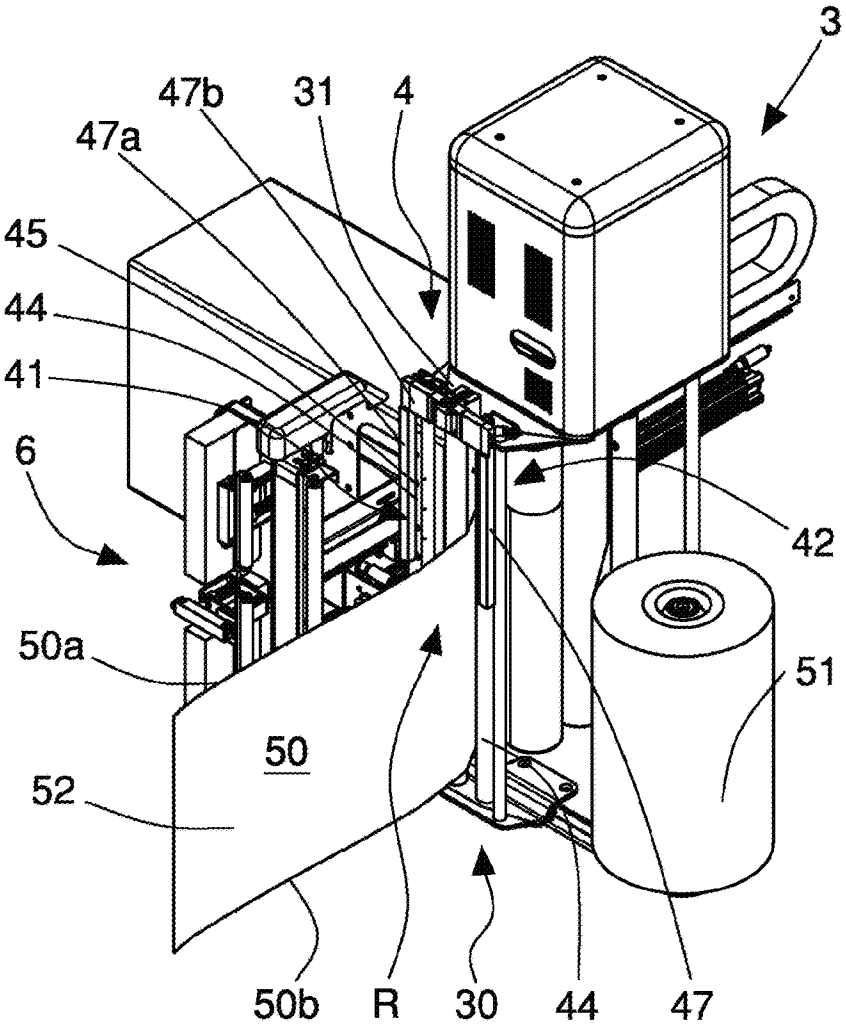

With reference to FIGS. 1 to 7, the wrapping machine 1 according to the invention for wrapping a load 100 with a film 50 of plastic material comprises an unwinding unit 3 provided with a reel 51 of film 50 and roller means 30 adapted for unwinding and/or pre-stretching the film 50.

The wrapping machine 1 further comprises transfer means 4 associated with the unwinding unit and configured to transfer an initial flap 52 of the film 50 unwrapped by the reel 51 from the roller means 30 to a wrapping area W in which the load 100 is wrapped with the film 50. The transfer means 4 comprise blowing means 41 positioned downstream of the roller means 30, with respect to a unwinding direction of film 50 and configured to emit air blows F towards the wrapping area W and towards the initial flap 52 of film so as to push and guide the initial flap along an unwinding direction T towards the wrapping area W. The blowing means 41 are for example connected to an air supply system of the wrapping machine 1, for example a blower, or to a pneumatic system of the structure in which the wrapping machine 1 is housed.

The transfer means 4 also comprise gripping means 42, adjacent to the blowing means 41 and adapted to grasp and retain the initial flap 52 of film at least in a pause step of the wrapping machine 1 during which the load 100 is not wrapped with the film, as better 5 explained in the following disclosure.

The blowing means 41 include at least one blowing element 44 having an elongated shape and arranged transversely, in particular orthogonally, to longitudinal edges 50*a*, 50*b* of the film 50. In particular, the blowing element 44 can be positioned side by side with respect to the gripping means 42 to push and transport the initial flap 52 towards the wrapping area W. In the preferred embodiment illustrated in the figures, the blowing means 41 comprise a pair of blowing elements 44 arranged parallel to each other on opposite sides of the film 50, which passes through them, adjacent to the gripping means 42 so as to effectively push the initial flap 52 of film towards the wrapping area W.

Each blowing element 44 is provided with blowing holes 45 distributed along its entire length and facing the wrapping area W and the initial flap 52 of film to emit a plurality of air blows or jets F. Preferably the holes are uniformly distributed along the entire length of the blowing element 44 so as to prevent the initial flap 52 of film 50 from folding back on itself during the transfer to the wrapping area W. More precisely, the blowing holes 45 are arranged along the length of the blowing element to form one or more rows of side-by-side blowing holes.

The arrangement of the blowing holes 45 allows the air blows F to push only the film 50 towards the wrapping area W without having it wrapped on itself.

In the illustrated embodiment, the gripping means 42 comprise a pair of gripping arms 47 movable between a gripping position S, in which they mutually come into abutment so as to grasp and retain a portion of the initial flap 52 of film, and a releasing position R, in which the gripping arms 47 are mutually spaced apart so as not to interact with the initial flap 52 of film 50. In particular, when the gripping arms 47 are in the releasing position R, the film 50 crosses the space freed by these to reach the wrapping area W.

Each gripping arm 47 is connected to the unwinding unit 3 rotatably about a respective rotation axis X. More precisely, the rotation axis X is substantially orthogonal to the longitudinal edges 50*a*, 50*b* of the film 50. Preferably the rotation axes X of each gripping arm 47 are parallel and side by side.

Each gripping arm 47 comprises a first portion 47*a* substantially elongated and adapted to abut the initial flap 52 of film. In particular, the first portion 47*a* is substantially orthogonal to the longitudinal edges 50*a*, 50*b* of the film 50.

Each gripping arm 47 comprises a second portion 47*b* having a free end, opposite to an end that is fixed to the first portion 47*a*, which is rotatably fixed to a supporting frame 31 of the unwinding unit 3.

The wrapping machine 1 comprises moving means 2, of known type and not described in detail, arranged to support and move the unwinding unit 3 at least along an operating direction A. In particular, the operating direction A is vertical. According to an alternative embodiment not shown, moving means 2 can also be configured to move the unwinding unit 3 about a vertical wrapping axis and about the unwinding area W for wrapping the load 100. The wrapping machine 1 includes a table 5, of known type and not described in detail, positioned in the wrapping area W and adapted to receive and support the load 100, in particular arranged above a pallet 101. In the embodiment illustrated in the figures, the table 5 is rotatable about a wrapping axis Z, in particular a vertical axis.

The wrapping machine 1 comprises cutting and fixing means 6, of known type and not described in detail, arranged to fix the film 50 to the load 100 (wrapped with a plurality of superimposed bands of said film) at the end of a wrapping cycle, and to cut the film 50 in a section comprised between the load 100 and the unwinding unit 3, in particular so as to carry out a final flap of film fixed to the load 100 and an initial flap 52 of film retained by the gripping means 42, as better explained in the following disclosure.

The wrapping machine 1 of the invention can be advantageously associated with a loading or palletizing apparatus, of known type and not illustrated in the figures, able to create the load 100 by arranging a plurality of products or articles or elements 101 grouped on a pallet 102 positioned on the table 5, according to on one or more superimposed layers.

The operation of the wrapping machine 1 of the invention provides in an initial step that an initial flap 52 of film is retained by the gripping arms 47 of the gripping means 42 arranged in the gripping position S in such a way that the initial flap 52 of film is stretched out, i.e. is not curled up on itself.

Subsequently, the blowing means 41 are activated to deliver, through the blowing holes 45, air blows F that impinge on the film 50, in particular the initial flap 52 of film. At this step the film 50 cannot be moved by the air blows as the gripping arms 47 of the gripping means 42 are tightened on the initial flap 52 in the gripping position S retaining it.

The film 50 is then unwound from the reel 51 by the roller means 30.

During the unwinding of the film 50, the gripping means 42 are arranged in the releasing position R so that the gripping arms 47 disengage the initial flap 52 of film, releasing it so that it can be licked by the air blows F and transferred inside the wrapping area W.

When the initial flap 52 of film is inside the wrapping area 52, the blowing means 41 are deactivated so as to stop the generation of the air blows F and the initial flap 52 falls on the rotatable table 5 or alternatively adheres to the load 100.

In particular, the initial flap 52 of film can be released into the wrapping area W on a pallet 101 previously positioned on the table 5, and is constrained to the pallet 102 by positioning on it one or more products or articles 101 that make up the load 100. More precisely, the weight of the product 101 allows the initial flap 52 of film to be constrained to the pallet 102. Thus, the initial flap 52 of film is attached to a portion of the load 100.

The initial flap 52 can be associated with the load 100 also by positioning a further product 101, i.e. when the composition of the load 100 has already been started, not necessarily when there are no products 101 in the wrapping area W.

When the initial flap 52 of film is stably fixed to the load 100 or to a part of the load 100 or to the pallet 102, in particular in the case in which the wrapping machine 1 is associated with a palletizer, the wrapping cycle can start.

After wrapping of the load 100, the gripping means 42 are activated and brought into the gripping position S to grasp and retain a portion of the film 50 interposed between the unwinding unit 3 and the load 100 and the cutting and fixing means 6 are also activated to fix a further portion of the film 50 to the load 100, for example by welding. The cutting and fixing means 6 are then further activated to cut the film 50 in a section comprised between the further portion of film, now fixed to the load 100, and the gripping means 4 in such a way as to obtain a final flap of film, which is fixed to the load 100 and an initial flap 52 of film which is retained by the gripping means 42. Such an initial flap 52 of film is suitable to be transferred to the wrapping area W at an initial step of the wrapping cycle of another load 100.

The invention also concerns a method for wrapping the load 100 with the plastic film 50 by means of the wrapping machine 1 described above and illustrated in FIGS. 1 to 7. In addition, the wrapping method comprises the steps of:

- retaining an initial flap 52 of film by means of the gripping means 42 arranged in the gripping position S;
- emitting air blows F directed towards the initial flap 52 of film and towards the wrapping area W by means of the blowing means 41 of the transfer means 4;
- unwinding the film 50 from the reel 51 by means of the roller means 30;
- releasing the initial flap 52 of film by arranging gripping means 42 in the releasing position R in such a way that the air blows F generated by the blowing means 41 push and guide the initial flap 52 of film along the unwinding direction T towards the wrapping area W;
- stopping the emission of the air blows F and the unwinding of the film 50 from the reel 51 when the initial flap 52 of film 50 is positioned in the wrapping area W;
- fixing the initial flap 52 of film to at least a portion of the load 100 and then starting a wrapping cycle.

Once the wrapping cycle has been completed, the method comprises:

- grasping and retaining a portion of film 50 interposed between the unwinding unit 3 and the load 100 by gripping means 42 arranged in the gripping position S;
- fixing a further portion of film to the load 100 by means of cutting and fixing means 6;
- cutting the film 50 in a section comprised between the further portion of film and the gripping means 42 by means of cutting and fixing means 6, so as to obtain a final flap of film fixed to the load 100 and an initial flap 52 of film retained by the gripping means 42.

More precisely, fixing the initial flap 52 of film comprises dropping the initial flap 52 of film on a pallet 102 or on a product 101 of the load 100 positioned in the wrapping area W, for example on the table 5, and arranging at least one further product 101 of the load 100 on the pallet 102 or on the product 101 so as to block the initial flap 52 of film.

The method further comprises, during the wrapping cycle, making up the load 100 by progressively introducing and superimposing the products 101 forming it.

Thanks to the wrapping machine 1 and the wrapping method of the invention it is possible to automatically provide an initial flap of film to start a wrapping cycle and to grasp and retain a flap of film correctly and firmly at the end of the wrapping cycle.

The transfer means 4, which comprise the blowing means 41 and the gripping means 42 positioned on the unwinding unit 3, allow in particular the film to be grasped and retained and therefore to be released easily and correctly without interfering in any way with the wrapping of the load.

Figure 8:
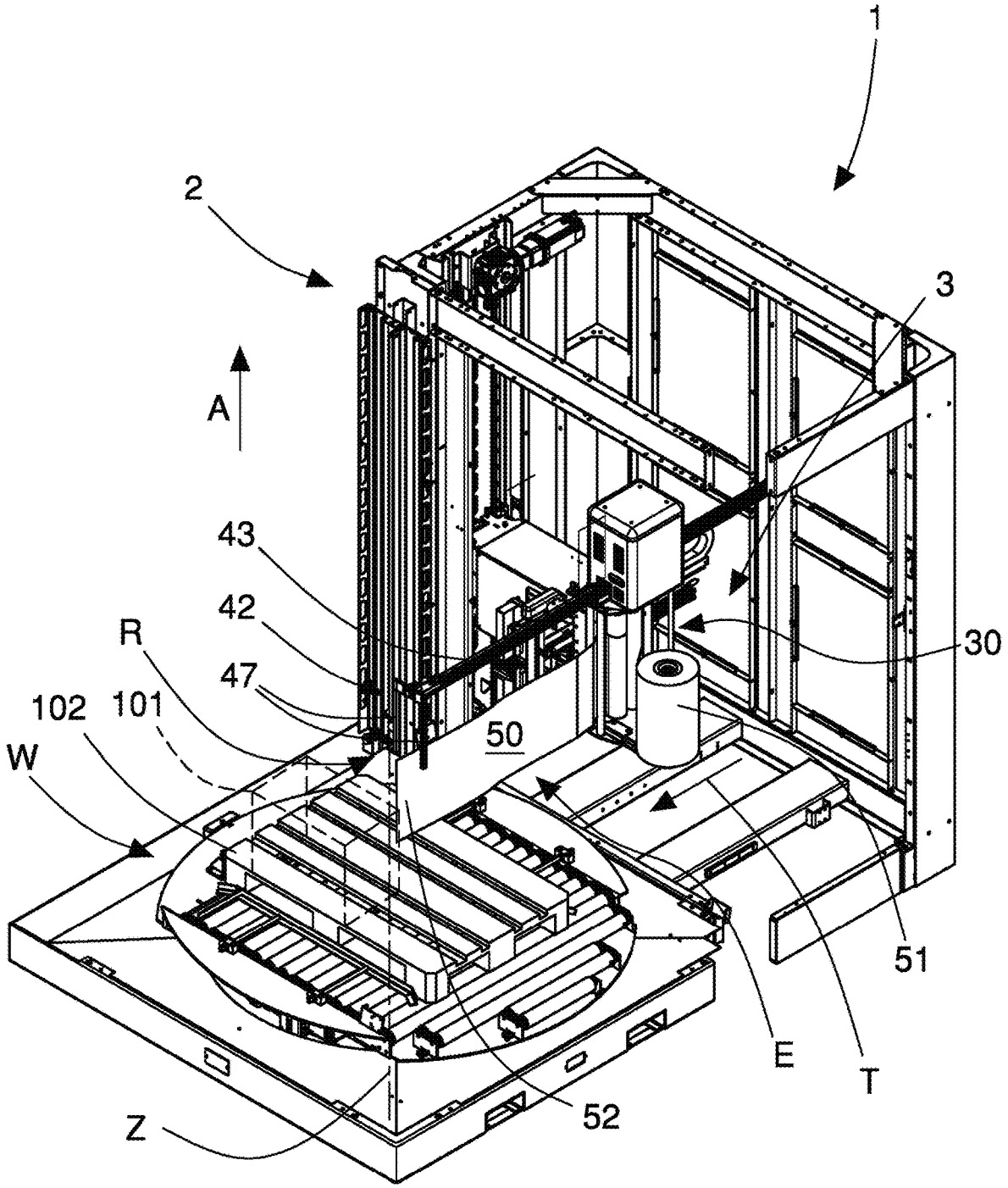
FIG. 8 is a perspective view of another embodiment of the wrapping machine, wherein a moving arm supporting the gripping means is arranged in an extended configuration.
Figure 12:
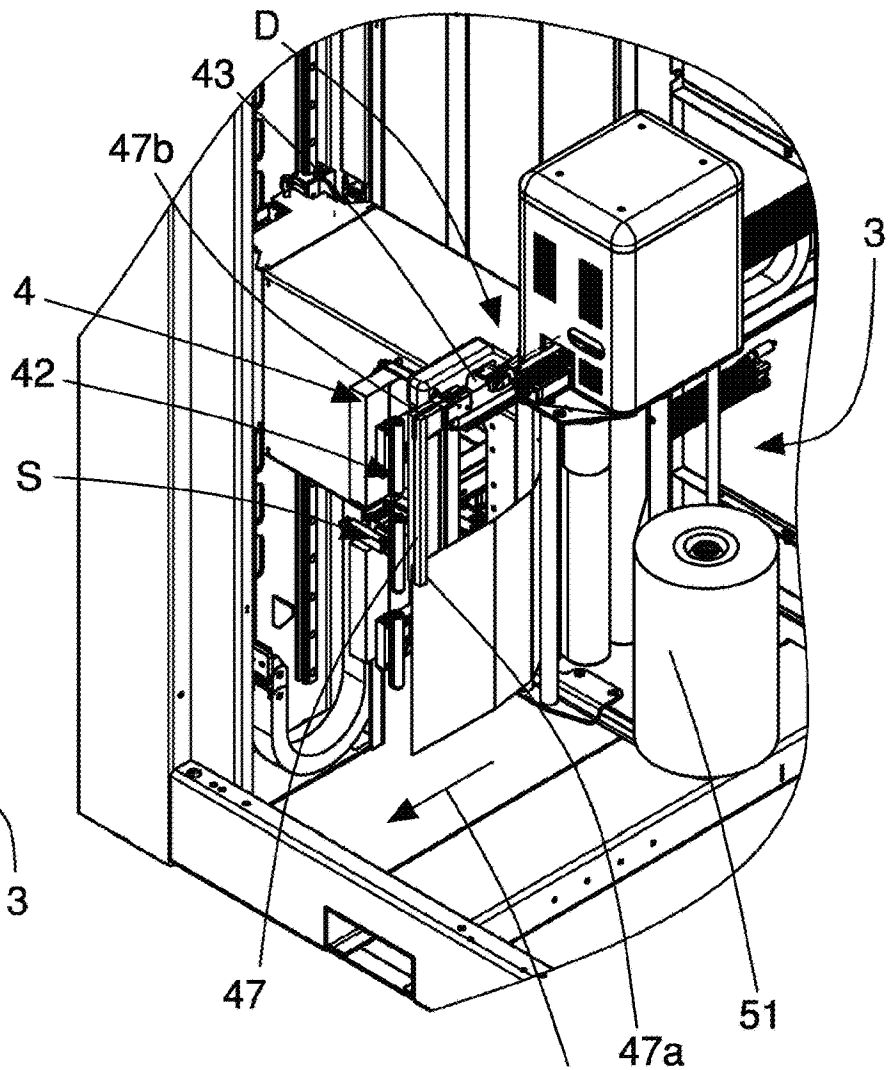
FIGS. 11 and 12 are partial enlarged views of the wrapping machine of FIG. 8 illustrating the unwinding unit with the moving arm supporting the gripping means in the gripping position and arranged respectively in an extended configuration and in a retracted configuration.
Figure 11:
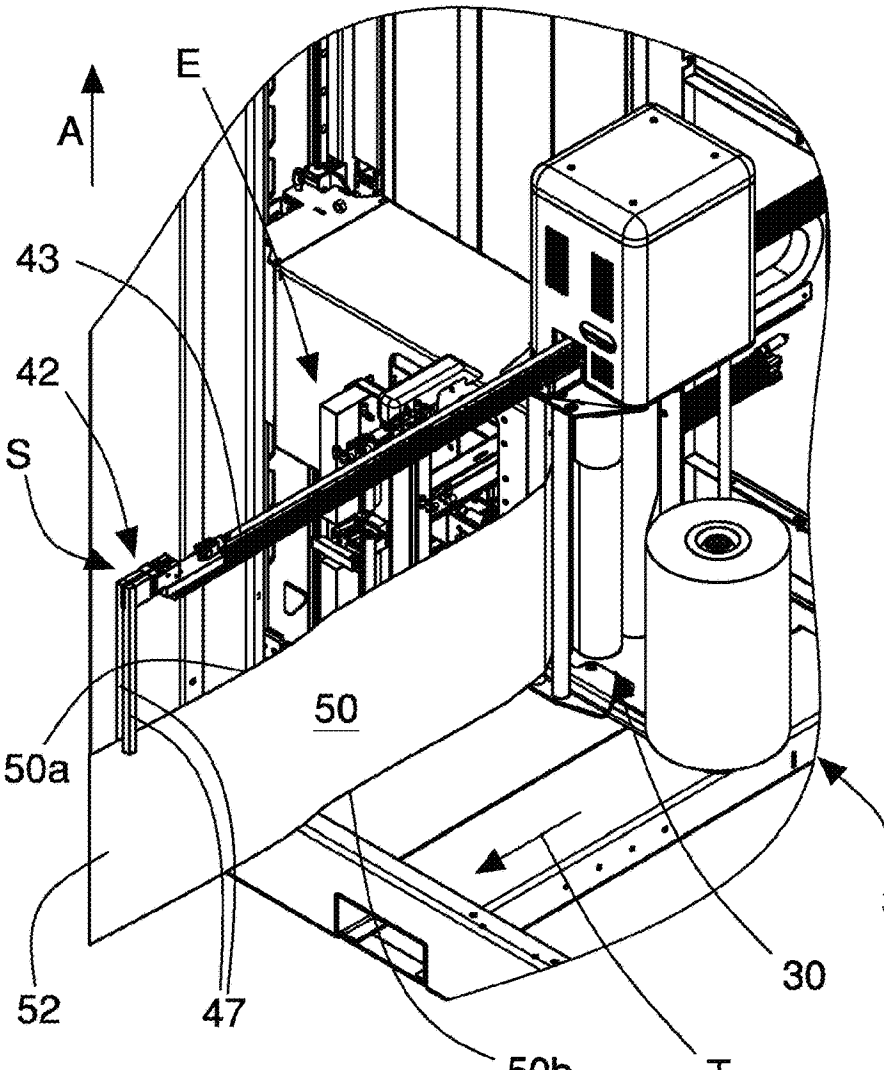

With particular reference to FIGS. 8 to 12, a variant of the wrapping machine 1 is illustrated that differs from the embodiment above described for the transfer means 4 associated with the unwinding unit 3 and configured to transfer an initial flap 52 of the film 50 unwound by the reel 51 from the roller means 30 into the wrapping area W, in which the load 100 is wrapped with the film 50.

The transfer means 4 comprise the gripping means 42 adapted to grasp and retain the initial flap 52 of film at least in a pause step of the wrapping machine 1, during which the load 100 is not wrapped with the film, and a moving arm 43 supported by the unwinding unit 3 and supporting the gripping means 42. The moving arm 43 is movable and is selectively driven for moving the gripping means 42 towards or away from the wrapping area W.

More precisely, the moving arm 43 is movable between a retracted configuration D, wherein the gripping means 42 are adjacent to the unwinding unit 3, and an extended configuration E, wherein the gripping means 42 are positioned inside the wrapping area W.

In particular, the moving arm 43 is slidably connected to a supporting frame 31 of the unwinding unit 3 and is movable linearly along an unwinding direction T between the retracted configuration D and the extended configuration E.

The moving arm 43 is driven by a linear actuator 39, e.g. a pneumatic cylinder or a linear electric motor.

Similarly to the previously described embodiment, the gripping means 42 comprise a pair of gripping arms 47 movable between a gripping position P, in which they mutually come into abutment so as to grasp and retain a portion of the initial flap 52 of film 50, and a releasing position R, in which the gripping arms 47 are mutually spaced apart so as not to interact with the initial flap 52 of film. Each gripping arm 47 is rotatably connected to an end portion 43*a* of the moving arm 43. In particular, each gripping arm 47 is rotatable about a respective rotation axis X, in particular almost orthogonal to the longitudinal edges 50*a*, 50*b* of the film 50.

Each gripping arm 47 includes a first elongated portion 47*a*, in particular almost orthogonal to longitudinal edges 50*a*, 50*b* of the film 50, and adapted to abut the initial flap 52 of film. Each gripping arm 47 further comprises a second portion 47*b*, in particular almost orthogonal to the first portion 47*a*, having a respective free end, opposite to an end fixed to the first portion 47*a*, which is rotatably fixed to the end portion 43*a* of the moving arm 43. In particular, the first portion 47*a* and the second portion 47*b* are mutually arranged such as to form an "L" shaped arm.

The wrapping machine 1 comprises moving means 2 arranged to support and move the unwinding unit 3 at least along an operating direction A, in particular a vertical direction. The wrapping machine 1 also comprises a table 5, positioned in the wrapping area W, and adapted to receive and support the load 100, in particular arranged above a pallet 102.

The rotating table 5 is rotatable about a wrapping axis Z, in particular a vertical axis.

The wrapping machine 1 is provided with the cutting and fixing means 6 arranged to fix the film 50 to the load 100 (wrapped with a plurality of superimposed bands of said film) at the end of a wrapping cycle and to cut the film 50, in a section between the load 100 and the unwinding unit 3, in particular so as to provide a final flap of film fixed to the load 100 and an initial flap 52 of film retained by the gripping means 42, as better explained in the following disclosure.

The wrapping machine 1 can be advantageously associated with a loading or palletizing apparatus, of known type and not illustrated in the figures, able to make up the load 100 by arranging a plurality of products or articles or elements 101 grouped on a pallet 102 positioned on the table 5, according to on one or more superimposed layers.

The operation of the wrapping machine 1 provides in an initial step that an initial flap 52 of film is retained by the gripping arms 47 of the gripping means 42 arranged in the gripping position S in such a way that the initial flap 52 of film is stretched out, i.e. is not curled up on itself. In this initial step, coincident with the pause step of the wrapping machine (in which no wrapping of the load is performed) the moving arm 43 is arranged in the retracted configuration D.

Subsequently the moving arm 43 is driven and moved so as to move the gripping means 42 with the initial flap 52 of film within the wrapping area W. At the same time, the roller means 30 are actuated so as to suitably unwind the film 50 from the reel 50.

The moving arm 43 is stopped when the gripping means 42 with the initial flap 52 of film are positioned within the unwinding area W, i.e. upon reaching the extended configuration E of the moving arm 43. Concurrently with reaching the extended configuration E of the moving arm 43, the roller means 30 are stopped so as to block the unwinding of the film 50 from the reel 51. The gripping means 42 are then actuated and arranged in the releasing position R so as to disengage the initial flap 52 of film.

The initial flap 52 of film can be released from the gripping means 42 in the wrapping area W on a pallet 101, previously positioned on the table 5, and can be constrained to the pallet 102 by positioning on the pallet one or more products or articles 101 that make up the load 100. More precisely, the weight of the product 101 allows the initial flap 52 of film to be constrained to the pallet 102. Thus, the initial flap 52 of film is attached to a portion of the load 100.

The initial flap 52 can be associated with the load 100 also by positioning a further product 101, i.e. when the composition of the load 100 has already been started.

Subsequently, the moving arm 43 is actuated and moved in the retracted configuration D so as to move the gripping means 42 away from the wrapping area W. When the initial flap 52 of film is stably fixed to the load 100 or to a part of the load 100 or to the pallet 102, in particular when the wrapping machine 1 is associated to a palletizer, and the moving arm 43 is arranged in the retracted configuration D the wrapping cycle can start.

At the end of the wrapping cycle, i.e. when the load 100 is completely wrapped by the film 50, the gripping means 42 are actuated and arranged in the gripping position S so as to grasp and retain a portion of film interposed between the unwinding unit 3 and the load 100.

At the same time or subsequently, the cutting and fixing means 6 are actuated to fix a further portion of film to the load 100, for example by welding, and to cut the film 50 in a section comprised between the further portion of film and the gripping means 42, so as to obtain a final flap of film fixed to the load 100 and an initial flap 52 of film which is retained by the gripping means 42. Such an initial flap 52 of film is suitable to be transferred to the wrapping area W at an initial step of the wrapping cycle of another load 100.

There is also provided a method for wrapping the load 100 with the plastic film 50 by means of the wrapping machine 1 disclosed above and illustrated in FIGS. 8 to 12. In particular, the wrapping method comprises the steps of:

- retaining the initial flap 52 of the film 50 by means of gripping means 42 arranged in the gripping position S and supported by the moving arm 43 arranged in the retracted configuration D;
- moving the moving arm 43 in an extended configuration E in order to move the gripping means 42 holding the initial flap 52 towards the wrapping area in which the load 100 is wrapped with the film 50, and unwinding the film 50 from the reel 51 by means of roller means 30;
- stopping the moving arm 43 in the extended configuration E in which the gripping means 42 holding the initial flap 52 are inside the unwinding area W and stopping the unwinding of the film 50 from the reel 51;

releasing the initial flap 52 of film by arranging the gripping means 42 in the releasing position R;

moving the moving arm 43 from the extended configuration E to the retracted configuration D to move the gripping means 42 away from the wrapping area W;

fixing the initial flap 52 of film to at least one wall of the load 100 and starting a wrapping cycle.

At the end of the wrapping cycle, the method comprises:

grasping and retaining a portion of film 50 interposed between the unwinding unit 3 and the load 100, by means of the gripping means 4 arranged in the gripping position S and supported by the moving arm 43 arranged in the retracted configuration D;

fixing a further portion of film to the load 100 by means of cutting and fixing means 6;

cutting the film 50 in a section comprised between the further portion of film and the gripping means 42, by means of cutting and fixing means 6, so as to obtain a final flap of film fixed to the load 100 and an initial flap 52 of film retained by the gripping means 42.

Furthermore, fixing the initial flap 52 comprises dropping the initial flap 52 on a pallet 102 or on a product 101 of the load 100 positioned in the wrapping area W and arranging at least one further product 101 of the load 100 on the pallet 102 or on a product 101 so as to block the initial flap 52 of film.

The method comprises, during the wrapping cycle, making up the load 100 by progressively introducing and superimposing the products 101 forming the load 100.

By using the wrapping machine 1 and the wrapping method disclosed above, it is possible to automatically provide an initial flap of film to start a wrapping cycle and to grasp and retain a flap of film correctly and firmly at the end of the wrapping cycle.

The transfer means 4 comprising the gripping means 42 positioned on the moving arm 43, selectively movable between the retracted configuration D and the extended configuration E, allow in particular grasping and retaining the film and therefore releasing it easily and correctly without interfering in any way with the wrapping of the load.

The invention claimed is:

1. A wrapping machine for wrapping a load with a film of plastic material, the wrapping machine comprising:

an unwinding unit provided with a reel of the film and rollers suitable for at least one between unwinding and pre-stretching the film;

a moving assembly arranged to support and move said unwinding unit at least along an operating direction; and a transfer system fixed to and supported by said unwinding unit and configured to transfer an initial flap of the film unwound from the reel by said rollers into a wrapping area of the wrapping machine in which the load is wrapped with the film, wherein said transfer system comprises:

a blowing arrangement positioned downstream of said rollers with reference to an unwinding direction of the film and configured to emit air blows towards said wrapping area and the initial flap of film to push and guide the initial flap along the unwinding direction towards said wrapping area; and a gripping assembly adjacent to said blowing arrangement and adapted to grasp and retain the initial flap of film at least during a pause step of the wrapping machine when the load is not wrapped with the film, and wherein said gripping assembly comprises a pair of gripping arms movable between a gripping position, in which said gripping arms mutually abut so as to grasp and retain a portion of the initial flap of film, and a releasing position, in which said gripping arms are mutually spaced apart so as not to interact with the initial flap of film, each gripping arm being connected to said unwinding unit rotatably about a respective rotation axis.

2. The wrapping machine according to claim 1, wherein said blowing arrangement comprises at least one blowing element having an elongated shape, arranged transverse to longitudinal edges of the film, said blowing element being provided with blowing holes distributed along its entire length and facing towards said wrapping area and towards the initial flap of film to emit a plurality of air blows.

3. The wrapping machine according to claim 2, wherein said at least one blowing element comprises a pair of blowing elements arranged parallel to each other on opposite sides of the film and adjacent to said gripping assembly so as to push the initial flap of film towards said wrapping area.

4. The wrapping machine according to claim 1, wherein each gripping arm comprises an elongated first portion suitable to abut the initial flap of film.

5. The wrapping machine according to claim 4, wherein each gripping arm further comprises a second portion having a respective free end, opposite to an end that is fixed to said elongated first portion, which is rotatably fixed to a supporting frame of said unwinding unit.

6. The wrapping machine according to claim 1, further comprising a table positioned in said wrapping area, said table being suitable to receive and support the load and rotatable about a wrapping axis.

7. The wrapping machine according to claim 1, further comprising a cutting and fixing assembly arranged to fix the film to the load at an end of a wrapping cycle and to cut the film in a section between the load and said unwinding unit.

8. A method for wrapping a load with a film of plastic material with the wrapping machine according to claim 1, the method comprising:

retaining an initial flap of the film with said gripping assembly arranged in a gripping position;

emitting air blows directed towards the initial flap of film and towards said wrapping area with said blowing arrangement of said transfer system;

unwinding the film from a reel with said rollers;

releasing the initial flap of film by arranging said gripping assembly in a releasing position so that the air blows generated by said blowing arrangement push and guide the initial flap of film along the unwinding direction towards said wrapping area;

stopping said emitting of the air blows and said unwinding of the film from the reel when the initial flap of film is positioned in said wrapping area; and fixing the initial flap of film to at least a part of the load and starting a wrapping cycle.

9. The method according to claim 8, further comprising, once finished with the wrapping cycle:

grasping and retaining with said gripping assembly arranged in the gripping position, a portion of film that is interposed between said unwinding unit and the load;

fixing a further portion of film to the load with a cutting and fixing assembly; and cutting the film in a section located between the further portion of film and said gripping assembly, with said cutting and fixing assembly so as to obtain a film final flap that is fixed to the load and an initial flap of film that is retained by said gripping assembly.

10. The method according to claim 8, wherein said fixing of the initial flap of film comprises dropping the initial flap of film on a pallet or on a product of the load that is positioned in said wrapping area and arranging at least one further product of the load on the pallet or on the product so as to block the initial flap of film.

11. The method according to claim 8, further comprising during the wrapping cycle making up the load by progressively entering and superimposing products which form the load.

12. A wrapping machine for wrapping a load with a film of plastic material, the wrapping machine comprising:

an unwinding unit provided with a reel of the film and rollers suitable for at least one between unwinding and pre-stretching the film;

a moving assembly arranged to support and move said unwinding unit at least along an operating direction;

a transfer system associated with said unwinding unit and configured to transfer an initial flap of the film unwound from the reel by said rollers into a wrapping area of the wrapping machine in which the load is wrapped with the film;

wherein said transfer system comprises:

a gripping assembly adapted to grasp and retain the initial flap of film;

a moving arm that is supported by said unwinding unit, supports said gripping assembly and is selectively operable to move said gripping assembly in, or move away from, said wrapping area, wherein said moving arm is slidably connected to a supporting frame of said unwinding unit and is movable linearly along an unwinding direction between a retracted configuration, in which said gripping assembly is adjacent to said unwinding unit, and an extended configuration, in which said gripping assembly is positioned inside said wrapping area, and wherein said gripping assembly comprises a pair of gripping arms movable between a gripping position, in which said gripping arms mutually abut so as to grasp and retain a portion of the initial flap of film, and a releasing position, in which said gripping arms are mutually spaced apart so as not to interact with the initial flap of film, each gripping arm being rotatably connected to an end portion of said moving arm rotatable about a respective rotation axis.

13. The wrapping machine according to claim 12, wherein each gripping arm comprises an elongated first portion suitable to abut the initial flap of film.

14. The wrapping machine according to claim 13, wherein each gripping arm further comprises a second portion having a respective free end, opposite to an end fixed to said elongated first portion, which is rotatably fixed to an end portion of said moving arm.

15. The wrapping machine according to claim 12, further comprising a table positioned in said wrapping area, said table being suitable to receive and support the load, and rotatable about a wrapping axis.

16. The wrapping machine according to claim 12, further comprising a cutting and fixing assembly arranged to fix the film to the load at an end of a wrapping cycle and to cut the film in a section between the load and said unwinding unit.

17. A method for wrapping a load with a film of plastic material with the wrapping machine according to claim 12, the method comprising:

retaining an initial flap of the film with said gripping assembly comprising said pair of gripping arms arranged in the gripping position and supported by said moving arm arranged in the retracted configuration, said moving arm being supported by said supporting frame of said unwinding unit;

moving linearly along the unwinding direction said moving arm in the extended configuration to move said gripping assembly, which retains the initial flap of film towards said wrapping area in which the load is wrapped with the film and unwinding the film from the reel with said rollers;

stopping said moving arm in the extended configuration, in which said gripping assembly, which retains the initial flap of film, is inside said wrapping area, and stopping said unwinding of the film from the reel;

releasing the initial flap of film by arranging said gripping assembly in the releasing position;

moving linearly along the unwinding direction said moving arm from the extended configuration to the retracted configuration in order to move away said gripping assembly from said wrapping area; and fixing the initial flap of film to at least a part of the load and starting a wrapping cycle.

18. The method according to claim 17, further comprising, once finished with the wrapping cycle:

grasping and retaining with said gripping assembly arranged in the gripping position and supported by said moving arm arranged in the retracted configuration, a portion of film that is interposed between said unwinding unit and the load;

fixing a further portion of film to the load with a cutting and fixing assembly; and cutting the film in a section located between the further portion of film and said gripping assembly with said cutting and fixing assembly so as to obtain a final flap of film that is fixed to the load and an initial flap of film that is retained by said gripping assembly.

19. The method according to claim 17, wherein said fixing of the initial flap of film comprises dropping the initial film flap on a pallet or on a product of the load that is positioned in said wrapping area and arranging at least one further product of the load on the pallet or on the product so as to block the initial flap of film.

20. The method according to claim 17, further comprising during the wrapping cycle making up the load by progressively introducing and superimposing products which form the load.

* * * * *